US009769892B2

(12) United States Patent
Lee et al.

(10) Patent No.: US 9,769,892 B2
(45) Date of Patent: Sep. 19, 2017

(54) METHOD OF OPERATING BACKLIGHT UNIT AND DISPLAY DEVICE INCLUDING BACKLIGHT UNIT

(71) Applicant: Samsung Display Co., Ltd., Yongin, Gyeonggi-Do (KR)

(72) Inventors: Dae-Sik Lee, Asan-si (KR); Jin-Won Jang, Asan-si (KR); SeungYoung Choi, Yongin-si (KR)

(73) Assignee: Samsung Display Co., Ltd. (KR)

( * ) Notice: Subject to any disclaimer, the term of this patent is extended or adjusted under 35 U.S.C. 154(b) by 357 days.

(21) Appl. No.: 14/676,469

(22) Filed: Apr. 1, 2015

(65) Prior Publication Data

US 2016/0081144 A1 Mar. 17, 2016

(30) Foreign Application Priority Data

Sep. 16, 2014 (KR) ..... 10-2014-0122843

(51) Int. Cl.

| | |
|---|---|
| ***G09G 3/36*** | (2006.01) |
| ***H05B 33/08*** | (2006.01) |
| ***G09G 5/10*** | (2006.01) |
| ***G09G 3/34*** | (2006.01) |

(52) U.S. Cl.

CPC ..... *H05B 33/083* (2013.01); *G09G 3/342* (2013.01); *G09G 5/10* (2013.01); *H05B 33/089* (2013.01); *G09G 2300/0426* (2013.01); *G09G 2320/0285* (2013.01); *G09G 2320/0626* (2013.01); *G09G 2330/025* (2013.01); *G09G 2330/045* (2013.01)

(58) Field of Classification Search

CPC ..... H05B 33/0815; H05B 33/083; H05B 33/0827; H05B 33/0851; H05B 33/0893; H05B 33/0809; H05B 33/0818; H05B 33/0824; H05B 33/0842; H05B 33/0848; H05B 33/0881; H05B 33/089; H05B 33/036; H05B 33/086; G09G 3/342; G09G 5/10; G09G 2300/0426; G09G 2320/0285

See application file for complete search history.

(56) References Cited

U.S. PATENT DOCUMENTS

2014/0192102 A1* 7/2014 Im ..... H05B 33/0827 345/691

FOREIGN PATENT DOCUMENTS

| | | | |
|---|---|---|---|
| KR | 10-2011-0015264 | A | 2/2011 |
| KR | 10-2013-0022810 | A | 3/2013 |
| KR | 10-2013-0104594 | A | 9/2013 |
| KR | 10-2014-0001002 | A | 1/2014 |

* cited by examiner

*Primary Examiner* — Kent Chang
*Assistant Examiner* — Mark Edwards
(74) *Attorney, Agent, or Firm* — Innovation Counsel LLP

(57) ABSTRACT

Provided is a display device. According to one embodiment, the display device includes: a backlight unit with a plurality of light emitting strings including at least one light emitting diode; and a display panel displaying an image using light outputted from the backlight unit, wherein the backlight unit includes: a light source unit including the plurality of light emitting strings and a plurality of photo transistors controlling the plurality of light emitting strings; a DC-DC converter outputting the driving voltage to the light source unit; and a driving control unit applying activated gate voltages to turn on the plurality of photo transistors and detecting driving time differences between an output time for outputting the driving voltage and applying times for applying the gate voltages.

15 Claims, 6 Drawing Sheets

| Tc | Vf |
|---|---|
| Tc1 ~ Tc2 | Vf1 |
| Tc2 ~ Tc3 | Vf2 |
| Tc3 ~ Tc4 | Vf3 |
| Tc4 ~ | Vf4 |

METHOD OF OPERATING BACKLIGHT UNIT AND DISPLAY DEVICE INCLUDING BACKLIGHT UNIT

CROSS-REFERENCE TO RELATED APPLICATIONS

This U.S. non-provisional patent application claims priority under 35 U.S.C. §119 of Korean Patent Application No. 10-2014-0122843, filed on Sep. 16, 2014, the entire contents of which are hereby incorporated by reference.

BACKGROUND

The present system and method disclosed herein relate to a display device, and more particularly, to a method of operating a backlight unit and a display device including the backlight unit.

A display device generally includes a display panel displaying an image, and a gate driving unit and a data driving unit driving a display panel. The display panel includes a plurality of gate lines, a plurality of data lines, and a plurality of pixels connected to the gate and data lines. The gate lines receive gate signals from the gate driving unit. The data lines receive data signals from the data driving unit. The pixels receive the data signals through the data lines in response to the gate signals provided through the gate lines. The pixels display grayscales corresponding to the voltage levels (hereinafter "data voltages") of the received data signals. As a result, an image is displayed.

Additionally, the display device includes a backlight unit providing light to the display panel. The backlight unit, as a light source generating light, may include a cold cathode fluorescent lamp (CCFL) or a light emitting diode (LED).

If the backlight unit includes an LED, a converter driven by DC current may be required to drive the LED. For example, the backlight unit may include a DC-DC converter that receives a low DC voltage and outputs a high DC voltage for driving the LED. In such case, when the LED is damaged, the backlight unit may need to include a protective device for cutting off the electric current being provided to the LED.

SUMMARY

The present disclosure provides a method of operating a backlight unit, including cutting off a driving voltage to a light source unit when a light emitting diode (LED) is determined to be damaged, and a display device including the backlight unit.

Embodiments of the present system and method include a method of operating a backlight unit, the method including: outputting a driving voltage to a plurality of light emitting strings including at least one light emitting diode; detecting time differences between an output time and a plurality of applying times, wherein the output time is a time for outputting the driving voltage and the plurality of applying times are times for respectively applying gate voltages to turn on a plurality of photo transistors that respectively control the plurality of light emitting strings; outputting a first detection time having a maximum time difference and a second detection time having a minimum time difference among the detected time differences; determining a detection voltage from a plurality of predetermined detection voltages, the detection voltage corresponding to a time difference between the first detection time and the second detection time; comparing the detection voltage and a reference detection voltage to generate a comparison result; and controlling an output of the driving voltage according to the comparison result.

In some embodiments, the plurality of predetermined detection voltages may be predetermined according to a time difference of the maximum time and the minimum time.

In some embodiments, the detection voltage may increase with an increase in a time difference of the maximum time and the minimum time.

In some embodiments, one of the plurality of predetermined detection voltages may be set as the reference detection voltage.

In some embodiments, when the detection voltage is higher than the reference detection voltage, the driving voltage is prevented from being outputted.

In some embodiments of the present system and method, a display device includes: a backlight unit with a plurality of light emitting strings including at least one light emitting diode; and a display panel displaying an image using light outputted from the backlight unit, wherein the backlight unit includes: a light source unit including the plurality of light emitting strings and a plurality of photo transistors controlling the plurality of light emitting strings; a DC-DC converter outputting the driving voltage to the light source unit; and a driving control unit applying gate voltages to turn on the plurality of photo transistors and detecting driving time differences between an output time for outputting the driving voltage and applying times for applying the gate voltages, wherein the driving control unit selects a first detection time having a maximum time difference and a second detection time having a minimum time difference from the driving time differences, compares a detection voltage corresponding to a time difference between the first and second detection times among a plurality of predetermined detection voltages and a reference detection voltage, and controls an output of the driving voltage according to the comparison result.

In some embodiments, the DC-DC converter may include a driving transistor and the output of the driving voltage may be adjusted according to the operation of the driving transistor.

In some embodiments, when the detection voltage is higher than the reference detection voltage, the driving control unit may continuously apply a gate voltage to a gate terminal of and to turn on the driving transistor.

In some embodiments, each photo transistor may include: a first terminal receiving the gate voltage; a second terminal connected to each light emitting string; and a third terminal connected to a resistor.

In some embodiments, the driving control unit may include: a driving comparison unit detecting a node voltage of the second terminal or the third terminal of the each photo transistor, comparing the detected node voltage to a reference voltage, and outputting the gate voltage to the each photo transistor according to the comparison result; a detection unit receiving the driving voltage and the gate voltage applied to each photo transistor and detecting the driving time differences to output the first and second detection times; a counter unit outputting the detection voltage corresponding to the time difference between the first and second detection times and the reference detection voltage; and a comparator comparing the detection voltage and the reference detection voltage and controlling an output of the driving voltage according to the comparison result.

In some embodiments, the counter unit may include a memory and information on the plurality of predetermined detection voltages may be stored in the memory according to a time difference between the maximum time difference and the minimum time difference.

In some embodiments, the reference detection voltage may be set to one of the plurality of predetermined detection voltages.

In some embodiments, the comparator may receive the reference detection voltage through a first comparison terminal and may receive the detection voltage through a second comparison terminal, wherein when the detection voltage is higher than the reference detection voltage, the driving voltage necessary for light generation may be prevented from being outputted.

In some embodiments, the driving comparison unit may include a plurality of driving comparators, and each comparator receives the reference voltage through a first driving terminal and may receive the node voltage through a second driving terminal.

In some embodiments, the each driving comparator may output the gate voltage to turn on a corresponding photo transistor when the node voltage reaches the reference voltage.

BRIEF DESCRIPTION OF THE DRAWINGS

The accompanying drawings illustrate exemplary embodiments of the present system and method and, together with the description, serve to explain the principles of the present system and method. In the drawings.

DETAILED DESCRIPTION

Figure 1:
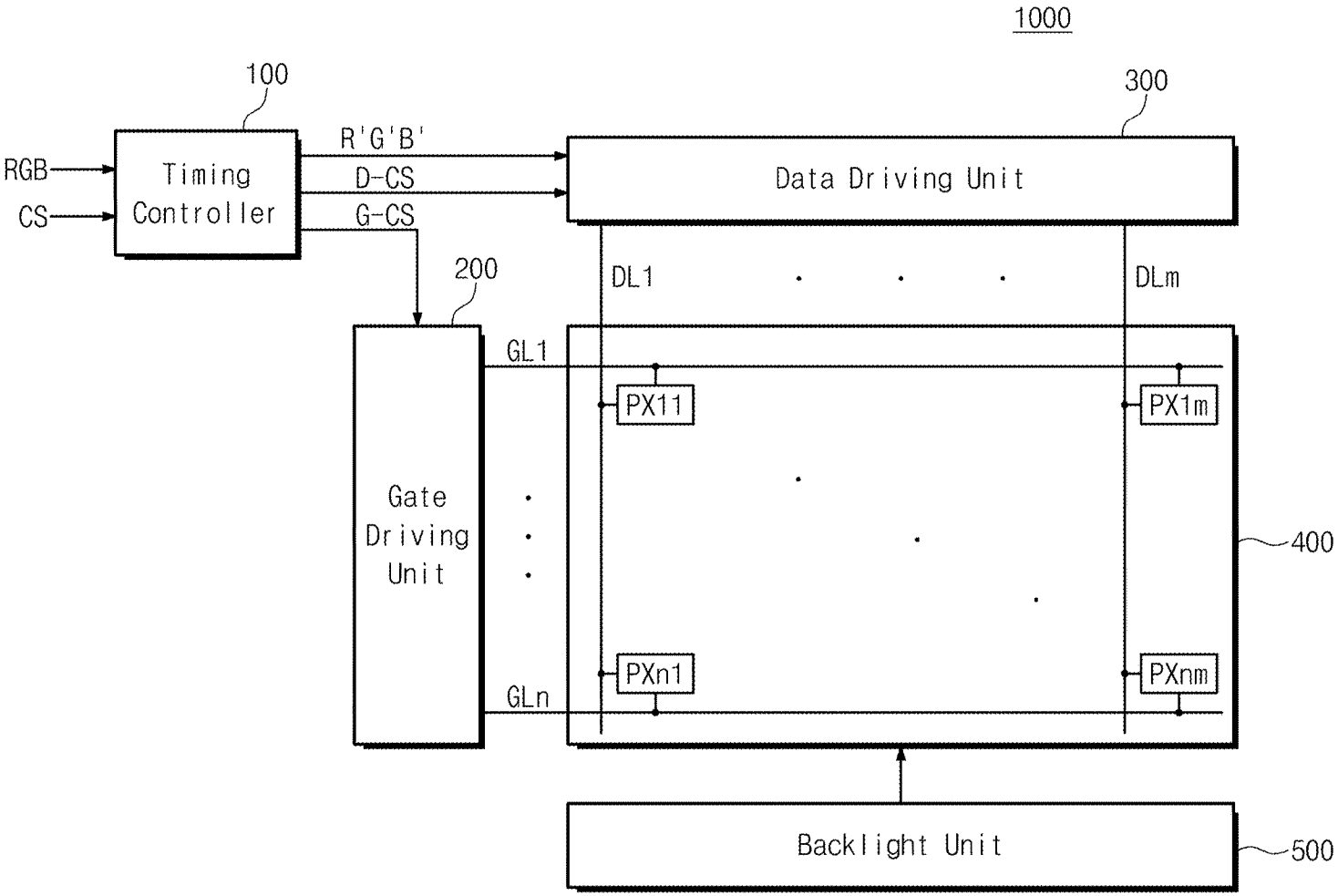
FIG. 1 is a block diagram of a display device, according to an embodiment of the present system and method.

Although specific embodiments of the present system and method are disclosed herein, a person of ordinary skill in the art would understand that various modifications are possible without departing from the scope and spirit of the present system and method. In other words, the present system and method also encompass other embodiments having these modifications and variations, and not just the specific embodiments disclosed herein.

In describing each drawing, like reference numerals refer to like components. In the accompanying drawings, the structures may not be drawn to scale, and therefore, the depicted dimensions may be larger or smaller than the actual dimensions. It is understood that the terms "first" and "second" are used herein to distinguish various components and do not otherwise limit any aspect of these components. For example, a first component may be referred to as a second component and vice versa, without departing from the scope of the present system and method. The terms used herein in their singular form may also include their plural form unless otherwise specified.

Additionally, in this specification, when the terms "include," "comprise," "including," or "comprising" are used to specify a property, a region, a fixed number, a step, a process, an element and/or a component, other properties, regions, fixed numbers, steps, processes, elements and/or components are not excluded.

FIG. 1 is a block diagram of a display device, according to an embodiment of the present system and method. Referring to FIG. 1, the display device 1000 includes a timing controller 100, a gate driving unit 200, a data driving unit 300, a display panel 400, and a backlight unit 500.

The timing controller 100 receives a plurality of image signals RGB and a plurality of control signals CS from a source external to the display device 1000. The timing controller 100 converts the data format of the image signals RGB to correspond to the interface specification of the data driving unit 300 and outputs the converted image signals R'G'B' to the data driving unit 300.

The timing controller 100 generates a data control signal D-CS and a gate control signal G-CS in response to control signals CS. For example, the data control signal D-CS may include an output start signal and a parallel start signal. The gate control signal G-CS may include a vertical start signal and a vertical clock bar signal. The timing controller 100 delivers the data control signal D-CS to the data driving unit 300 and delivers the gate control signal G-CS to the gate driving unit 200.

The gate driving unit 200 generates a plurality of gate signals in response to the gate control signal G-CS provided from the timing controller 100. The gate driving unit 200 sequentially outputs the gate signals to the display panel 400 through a plurality of gate lines GL1 to GLn. Thus, each row of a plurality of pixels PX11 to PXnm included in the display panel 400 may be sequentially scanned in response to the gate signals.

The data driving unit 300 converts the image signals R'G'B' into a plurality of data voltages in response to the data control signal D-CS provided from the timing controller 100. The data driving unit 300 outputs the converted data voltages to the display panel 400 through a plurality of data lines DL1 to DLm.

The display panel 400 includes the gate lines GL1 to GLn, the data lines DL1 to DLm, and pixels PX11 to PXnm. The gate lines GL1 to GLn extend in a row direction and intersect the data lines DL1 to DLm extending in a column direction. The gate lines GL1 to GLn are electrically connected to and receive gate signals from the gate driving unit 200 The data lines DL1 to DLm are electrically connected to and receive data voltages from the data driving unit 300. The pixels PX11 to PXnm are connected to a corresponding one of the gate lines GL1 to GLn and a corresponding one of the data lines DL1 to DLm.

The backlight unit 500 supplies light to the display panel 400. The backlight unit 500 may include a plurality of light emitting diodes (LEDs). According to an embodiment of the present system and method, the backlight unit 500 may include a plurality of light emitting strings (see FIG. 3) in which a plurality of LEDs are connected in series to each other.

Moreover, the backlight unit 500 may perform DC-DC conversion of an input voltage provided from an external source into a driving voltage suitable for light generation.

However, an over-current phenomenon may occur during the DC-DC conversion process and cause damage to some of the LEDs.

According to an embodiment of the present system and method, when the backlight unit 500 is turned on initially, it detects whether there are damaged LEDs among the plurality of LEDs. Based on the detection result, the backlight unit 500 may prevent the driving voltage from being provided to the plurality of LEDs.

Figure 2:
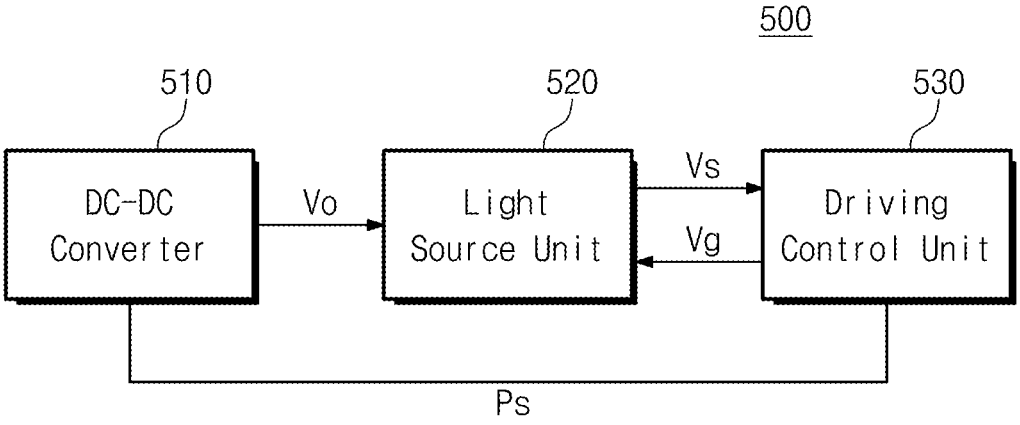
FIG. 2 is a block diagram illustrating a backlight unit shown in FIG. 1, according to an embodiment of the present system and method.

FIG. 2 is a block diagram illustrating the backlight unit shown in FIG. 1, according to an embodiment of the present system and method. Referring to FIG. 2, the backlight unit 500 includes a DC-DC converter 510, a light source unit 520, and a driving control unit 530.

The DC-DC converter 510 receives an input voltage from an external source (not shown). The DC-DC converter 510 converts the received input voltage into a driving voltage Vo for use by the light source unit 520. The DC-DC converter 510 provides the driving voltage Vo to the light source unit 520.

The light source unit 520 receives the driving voltage Vo generated by the DC-DC converter 510. The light source unit 520 includes a plurality of strings having a plurality of LEDs connected in series to each other and generates light in response to receiving the driving voltage Vo. Each light emitting string is connected in series to a photo transistor (see FIG. 3) and generates light when the photo transistor is turned on. The light source unit 520 provides the generated light to the display panel 400 (see FIG. 1).

Additionally, the light source unit 520 is electrically connected to the driving control unit 530. The plurality of LEDs included in the light source unit 520 operates in response to gate voltages Vg received from the driving control unit 530. A corresponding one of the gate voltages Vg is applied to a gate terminal of a photo transistor connected to each light emitting string. The light source unit 520 outputs source voltages Vs of the photo transistors to the driving control unit 530. This is described in more detail below with reference to FIG. 3.

The driving control unit 530 detects the source voltages Vs of the photo transistors and compares the source voltages Vs to a reference voltage Vref. The driving control unit 530 determines and outputs the gate voltages Vg for turning on the photo transistors according to the comparison results. For example, when the source voltage Vs of the photo transistor reaches the reference voltage, the driving control unit 530 may provide the gate voltage Vg to turn off the driving transistor to a gate terminal of the driving transistor (i.e., operate the photo transistor in the active, or saturation, mode).

Moreover, according to an embodiment of the present system and method, the driving control unit 530 may detect the arrival time at which the source voltage Vs reaches the reference voltage for each of the phototransistors connected to the light emitting strings. This would allow the driving control unit 530 to determine whether there are damaged LEDs among the plurality of LEDs included in the light source unit 520 by comparing the arrival times at which the source voltage Vs of each photo transistor reached the reference voltage. This is described in more detail below with reference to FIG. 3.

When it is determined that there are damaged LEDs among the plurality of LEDs, the driving control unit 530 may prevent the DC-DC converter 510 from outputting the driving voltage Vo. For example, the driving control unit 530 may output a driving pulse signal Ps to control the output of the driving voltage Vo to the light source unit 520. As a further example, when the driving control unit 530 is continuously providing the driving pulse signal Ps to turn on the driving transistor M (see FIG. 3), the driving voltage 530 is not being provided to the light source unit 520. That is, when the driving pulse signal PS is continuously provided to turn on the driving transistor M, the DC-DC converter 510 does not provide the driving voltage Vo necessary for light generation, and light is not outputted by the light source unit 520.

Figure 3:
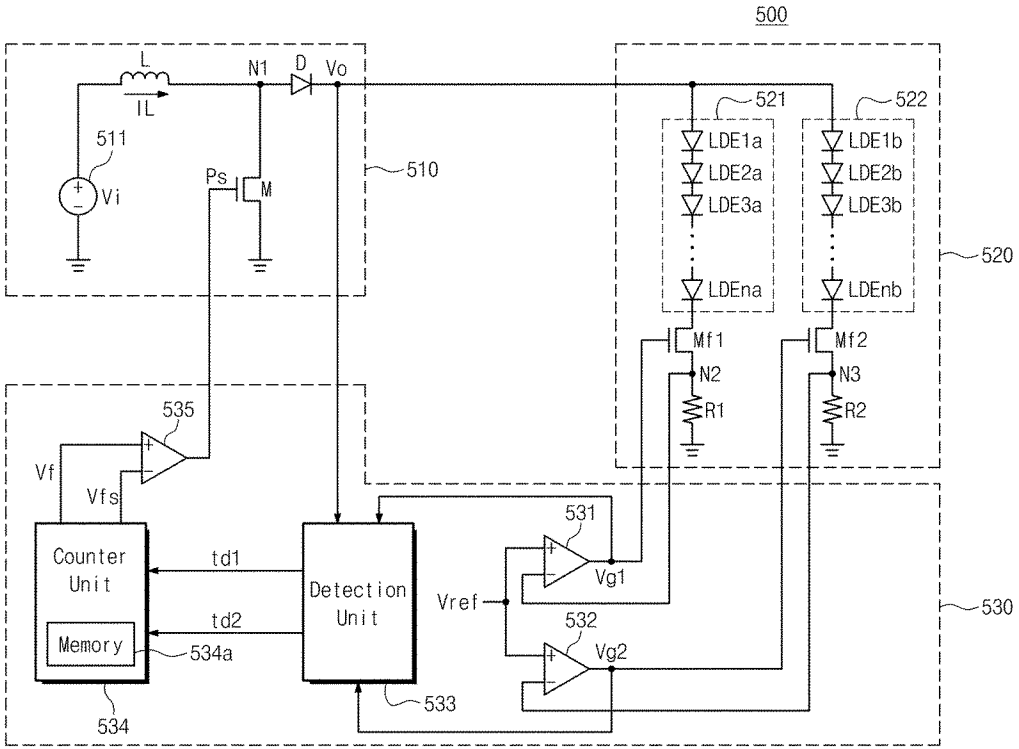
FIG. 3 is a circuit diagram illustrating the backlight unit shown in FIG. 1, according to an embodiment of the present system and method.

FIG. 3 is a circuit diagram illustrating the backlight unit shown in FIG. 1, according to an embodiment of the present system and method. Referring to FIG. 3, the DC-DC converter 510 includes an input power 511, an inductor L, a driving transistor M, and a diode D. The DC-DC converter 510 performs DC-DC conversion of an input voltage Vi into a driving voltage Vo for driving the backlight unit 500.

The input power 511 is connected to a ground terminal at one end and the inductor L at another end. The input voltage 511 generates the input voltage Vi and is a DC component.

One end of the inductor L is connected to the input power 511 and the other end is connected to a first node N1. Depending on the state of the driving transistor M, the inductor L may charge or output a driving current IL in response to the input power Vi.

The driving transistor M may be implemented as an NMOS transistor and disposed between the first node N1 and the ground terminal. In the case of FIG. 3, the driving transistor M has its drain terminal connected to the first node N1, its source terminal connected to the ground terminal, and its gate terminal connected to the driving control unit 530. That is, the driving transistor M may operate in response to a driving pulse signal Ps outputted from the driving control unit 530.

For example, when the driving transistor M is turned on in response to the driving pulse signal Ps, a level of the driving current IL of the inductor L starts to rise in response to the input voltage Vi. However, because the diode D is not conducted, the current outputted through the inductor L is not delivered to an output terminal of the DC-DC converter 510. Instead, the current outputted to the first node N1 through the inductor L flows through the driving transistor M to the ground.

On the other hand, when the driving transistor M is turned off in response to the driving pulse signal Ps, the driving current IL charged in the inductor L is provided to the light source unit 520 through the diode D. In this case, because the diode D is conducted, the level of the driving current IL of the inductor L starts to drop, and a voltage level equal to the sum of the driving voltage Vo and the input voltage Vi of the inductor L is provided to the first node N1, thereby increasing the driving voltage Vo.

The light source unit 520 includes a first light emitting string 521, a second light emitting string 522, a first photo transistor Mf1, a second photo transistor Mf2, a first resistor R1, and a second resistor R2. Although only two (i.e., the first and second strings 521 and 522) are shown in FIG. 3, the present system and method are not limited thereto. That is, the light source unit 520 may include additional light emitting strings.

The first light emitting string 521 includes a plurality of first light emitting diodes LED1*a*~LEDna and receives the driving voltage Vo from the DC-DC converter 510. The first photo transistor Mf1 is disposed between the first LEDs LED1*a* to LEDna and a second node N2 and controls the operations of the first LEDs LED1*a* to LEDna in response to a first gate voltage Vg1 applied to a gate terminal of the photo transistor Mf1.

For example, when the first gate voltage Vg1 is provided to the first photo transistor Mf1, turning it on, and the driving voltage Vo is provided from the DC-DC converter 510, the first LEDs LED1*a* to LEDna output light. On the other hand, when the first gate voltage Vg1 is not provided or is insufficient to turn on the first photo transistor Mf1, the first LEDs LED1*a* to LEDna do not output light. The first resistor R1 is connected between the second node N2 and the ground terminal to determine a source voltage of the first photo transistor Mf1.

The second light emitting string 522 includes a plurality of second light emitting diodes LED1*b*~LEDnb and receives the driving voltage Vo from the DC-DC converter 510. The second photo transistor Mf2 is disposed between the second LEDs LED1*b* to LEDnb and a third node N3 and controls the operations of the second LEDs LED1*b* to LEDnb in response to a second gate voltage Vg2 applied to a gate terminal of the photo transistor Mf2. Because the operations of the second photo transistor Mf2 are the same or substantially the same as those of the first photo transistor Mf1 described above, their descriptions are omitted.

According to an embodiment of the present system and method, when the backlight unit 500 is turned on initially and the driving voltage Vo is being outputted, the driving control unit 530 detects the time at which a gate voltage is provided to turn on each of the first and second photo transistors Mf1 and Mf2. If there is no damaged LED in the light source unit 520, the times at which the gate voltages are provided to the first and second photo transistors Mf1 and Mf2 would be the same or substantially the same.

However, if a light emitting string includes a damaged LED, the times at which the gate voltages for turning on the photo transistors would be different. Thus, the backlight unit 500 may determine whether an LED is damaged by comparing the times at which a gate voltage is provided to turn on each of the photo transistors when the driving voltage Vo is outputted.

As FIG. 3 shows, the driving control unit 530 includes a first comparator 531, a second comparator 532, a detection unit 533, a counter unit 534, and a third comparator 535.

The first comparator 531 receives a source voltage of the first photo transistor Mf1 from the second node N2 through a first terminal (−) and a reference voltage Vref from an external source through a second terminal (+). The first comparator 531 compares the reference voltage Vref and the source voltage of the first photo transistor Mf1 and outputs a first gate voltage Vg1 based on the comparison result. For example, when the source voltage of the first photo transistor Mf1 is lower than the reference voltage Vref, the first comparator 531 outputs a first gate voltage Vg1 that is higher by a predetermined level than the previous first gate voltage Vg1. As a result, a source voltage level of the first photo transistor Mf1 increases.

On the other hand, when a source voltage of the first photo transistor Mf1 is higher than the reference voltage Vref, the first comparator 531 outputs a first gate voltage Vg1 that is lower by a predetermined level than the previous first gate voltage Vg1. As a result, a source voltage level of the first photo transistor Mf1 decreases.

The first comparator 531 repeats the above operation until the source voltage of the first photo transistor Mf1 reaches the reference voltage Vref. When the source voltage of the second node N2 reaches the reference voltage Vref, the first comparator 531 outputs the first gate voltage Vg1 having a voltage level sufficient to turn on the first photo transistor Mf1.

In the same manner, the second comparator 532 compares the reference voltage Vref and a source voltage of the second photo transistor Mf2 and outputs a second gate voltage Vg2 based on the comparison result. For example, when the source voltage of the second photo transistor Mf2 is lower than the reference voltage Vref, the second comparator 532 outputs a second gate voltage Vg2 that is higher by a predetermined level than the previous second gate voltage Vg2. As a result, a source voltage level of the second photo transistor Mf2 increases.

On the other hand, when the source voltage of the second photo transistor Mf2 is higher than the reference voltage Vref, the second comparator 532 outputs a second gate voltage Vg2 that is lower by a predetermined level than the previous second gate voltage Vg2. As a result, a source voltage level of the second photo transistor Mf2 decreases.

The second comparator 532 repeats the above operation until the source voltage of the second photo transistor Mf2 reaches the reference voltage Vref. When the source voltage of the second photo transistor Mf2 reaches the reference voltage Vref, the second comparator 532 outputs the second gate voltage Vg2 having a voltage level sufficient to turn on the second photo transistor Mf2.

The resistive values of the first resistor R1 and the second resistor R2 may be set equal to each other. During normal operation in which an LED is not damaged, the first light source unit 521 and the second light source unit 522 provide the same output current to the first and second photo transistors Mf1 and Mf2. Therefore, in the case when the first and second resistors R1 and R2 are equal in resistive values, and the first and second photo transistors Mf1 and Mf2 are drawing the same current level, the source voltages of the first and second photo transistors Mf1 and Mf2 are also the same in value.

Additionally, during normal operation of the backlight unit 500, the reference voltage Vref may be set based on the source voltages of the first and second photo transistors Mf1 and Mf2. The first and second comparators 531 and 532 may regulate the source voltages of the first and second photo transistors Mf1 and Mf2 towards the reference voltage Vref by adjusting the output level of the first and second gate voltages Vg1 and Vg2.

However, when one of the first and second light emitting strings 521 and 522 includes a damaged LED, the voltage level applied to a drain terminal of a photo transistor may vary. Hereinafter, an example in which at least one of the first LEDs LED1*a* to LED1*n* in the first light emitting string 521 is damaged is described.

In this example, because the first light emitting string 521 has one or more damaged LEDs, the drain voltage of the first photo transistor Mf1 may be higher than the drain voltage of the second photo transistor Mf2. Due to the increase in the drain voltage of the first photo transistor Mf1, the gate voltage level applied to the gate terminal of the first photo transistor Mf1 decreases. This is described further with reference to FIG. 4.

Figure 4:
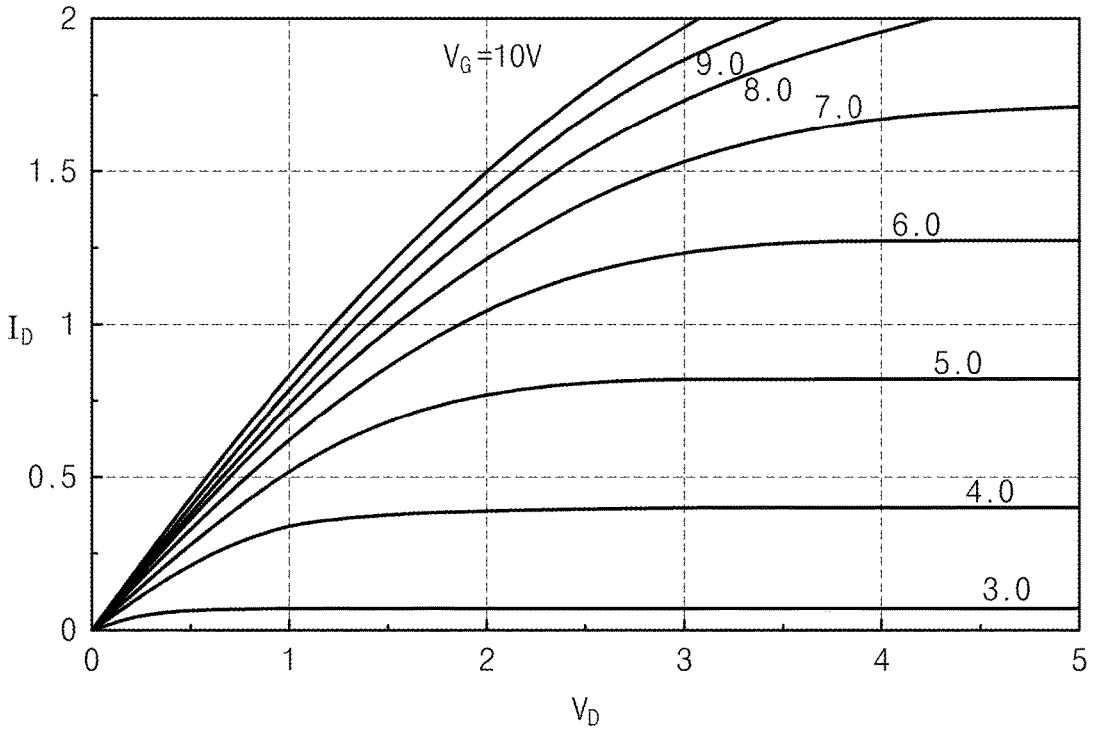
FIG. 4 is a graph illustrating characteristics between a drain and a gate of a typical transistor, according to an embodiment of the present system and method.

FIG. 4 is a graph illustrating characteristics between a drain and a gate of a typical transistor, according to an embodiment of the present system and method. An x-axis shows a drain voltage VDS of a transistor and a y-axis shows a current amount ID provided to a drain terminal. Referring to FIGS. 3 and 4, as the drain voltage VDS of a transistor becomes higher, a gate voltage VGS becomes lower. On the other hand, as the drain voltage VDS of a transistor becomes lower, a gate voltage VGS becomes higher. For example, as a drain voltage of the first photo transistor Mf1 becomes higher, the voltage level of the first gate voltage Vg1 at which the first photo transistor Mf1 is turned on becomes lower.

Figures 5, 6:
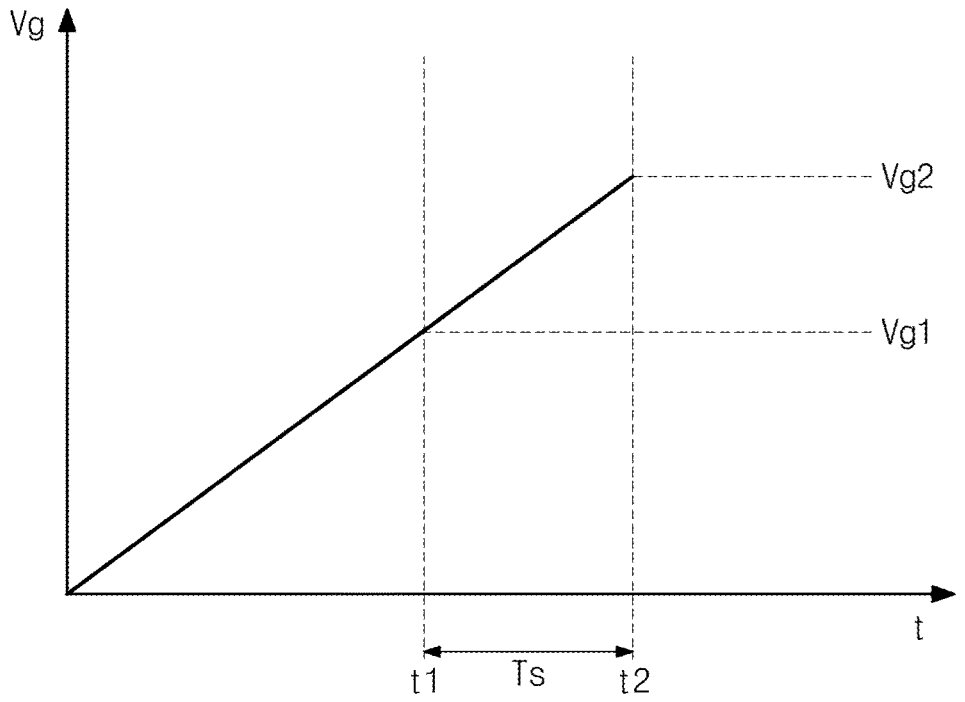
FIG. 5 is a graph illustrating gate voltages of first and second photo transistors shown in FIG. 3, according to an embodiment of the present system and method.
FIG. 6 is a lookup table storing a detection voltage corresponding to a differential operation of first and second detection times described with reference to FIG. 3, according to an embodiment of the present system and method.

FIG. 5 is a graph illustrating gate voltages of the first and second photo transistors shown in FIG. 3, according to an embodiment of the present system and method. An x-axis shows time t and a y-axis shows gate voltage Vg.

Referring to FIGS. 3 and 5, at the first time t1, the first gate voltage Vg1 has a voltage level sufficient to turn on the first photo transistor Mf1. At the second time t2, the second gate voltage Vg2 has a voltage level sufficient to turn on the second photo transistor Mf2. The first time t1 is the time at which the first photo transistor Mf1 is turned on by the first gate voltage Vg1 after the driving voltage Vo is outputted from the DC-DC converter 510. The second time t2 is the time at which the second photo transistor Mf2 is turned on by the second gate voltage Vg2 after the driving voltage Vo is outputted from the DC-DC converter 510.

Because the first light emitting string 521 includes a damaged LED, the drain voltages of the first and second photo transistors Mf1 and Mf2 are different from each other. This means that the voltage level at which the first photo transistor Mf1 is turned on is different from the voltage level at which the second photo transistor Mf2 is turned on. As a result, a time difference Ts between the first time t1 and the second time T2 occurs. That is, the first gate voltage Vg1 for turning on the first photo transistor Mf1 is achieved sooner than the second gate voltage Vg2 for turning on the second photo transistor Mf2 is achieved. Although the turn-on time of the first gate voltage Vg1 is shown to be faster than the turn-on time of the second gate voltage Vg2 in FIG. 5, it is just an example, the present system and method are not limited thereto. That is, the turn-on time of each gate voltage may vary according to the voltage level of the reference voltage Vref.

Referring to FIG. 3 again, the detection unit 533 receives a first gate voltage Vg1 outputted from the first comparator 531 and a second gate voltage Vg2 outputted from the second comparator 532. The detection unit 533 also receives the driving voltage Vo being outputted when the DC-DC converter 510 is turned on initially. The detection unit 533 detects the first time t1 from the output time of the driving voltage Vo to the turn-on time of the first gate voltage Vg1. In the same manner, the detection unit 533 detects the second time t2 from the output time of the driving voltage Vo to the turn-on time of the second gate voltage Vg2.

According to an embodiment of the present system and method, the detection unit 533 determines a first detection time td1 having a minimum time and a second detection time td2 having a maximum time based on the detected first and second times t1 and t2. Then, the detection unit 533 outputs the first detection time td1 and the second detection time td2 to the counter unit 534. Because the first time t1 is shorter than the second time t2, the first time t1 is set to the first detection time td1 and the second time t2 is set to the second detection time td2.

The counter unit 534 receives the first and second detection times td1 and td2 from the detection unit 533. The counter unit 534 subtracts the first detection time td1 having a shorter time from the second detection time td2 having a maximum time to determine a time differential. The counter unit 534 then determines a detection voltage Vf corresponding to the time differential. The counter unit 534 outputs the determined detection voltage Vf to the third comparator 535. The counter unit 534 also outputs a reference detection voltage Vfs to the counter unit 535.

According to an embodiment of the present system and method, the third comparator 535 compares the detection voltage Vf and the reference detection voltage Vfs and, based on the comparison result, outputs a driving pulse signal Ps to control the operation of the driving transistor M.

For example, when the detection voltage Vf is higher than the reference detection voltage Vfs, the third comparator 535 outputs the driving pulse signal Ps to turn off the driving transistor M. That is, when the detection voltage Vf is higher than the reference detection voltage Vfs, the third comparator 535 determines that there is a damaged LED among LEDs. As a result, an operation of the DC-DC converter 510 is stopped.

Additionally, the counter unit 534 may include a memory 534*a* for storing detection voltages Vf that correspond to time differentials. For example, the counter unit 534 may output the detection voltage Vf corresponding to a time differential based on the lookup table stored in the memory 534*a*. The memory 534*a* may be implemented with non-volatile memory.

FIG. 6 is a lookup table of detection voltages that correspond to differential operations of the first and second detection times of the detection unit described with reference to FIG. 3. Referring to FIGS. 3 and 6, the memory 534*a* may include a lookup table storing first to fourth detection voltages Vf1, Vf2, Vf3, and Vf4 that correspond to various time differentials Tc.

For example, when the time differential Tc between the second detection time td2 and the first detection time td1 is included in the range of the first time differential Tc1 to the second time differential Tc2, the counter unit 534 outputs the first detection voltage Vf1. When the time differential Tc is included in the range of the second time differential Tc2 to the third time differential Tc3, the counter unit 534 outputs the second detection voltage Vf2. When the time differential Tc is included in the range of the third time differential Tc3 to the fourth time differential Tc4, the counter unit 534 outputs the third detection voltage Vf3. When the time differential Tc is greater than the fourth time differential Tc4, the counter unit 534 outputs the fourth detection voltage Vf4.

The time differential may become greater as it approaches from the first time differential Tc1 to the fourth time differential Tc4 among the first to fourth time differentials Tc1 to Tc4. The detection voltage may also become greater as it approaches from the first time differential Tc1 to the fourth time differential Tc4 among the first to fourth time differentials Tc1 to Tc4. That is, as the time differential Tc becomes greater, the detection voltage Vf may increase.

Moreover, one of the first to fourth detection voltages Vf1 to Vf4 stored in the memory 534*a* may be set as a reference detection voltage Vfs. Consider the example in which the third detection voltage Vf3 is set as the reference detection voltage Vfs. In that example, when it is determined that a detection voltage Vf according to a time differential Tc is greater than the third direction voltage Vf3, at least one among the plurality of LEDs in the light source unit 520 may be damaged. Accordingly, the third comparator 535 may continuously provide a driving pulse signal Ps to a gate terminal of and to turn on the driving transistor M.

Additionally, although the time differentials Tc stored in the memory 534*a* is classified into four ranges, it is not limited thereto. That is, the time differentials Tc may be set based on a plurality of ranges. Accordingly, the memory 534*a* may store a plurality of detection voltages corresponding to the time differentials Tc.

Additionally, according to an embodiment of the present system and method, a driving control unit detects a source voltage of each photo transistor and, based on a detection result, detects whether a gate voltage is sufficient to turn on a corresponding photo transistor. However, the present system and method are not limited thereto. For example, although not shown in the drawing, a driving control unit may determine whether an LED is damaged by detecting the drain voltage of each photo transistor, instead of detecting source voltage as described above. Based on the detection result, the driving control detects whether a gate voltage is sufficient to turn on a corresponding photo transistor. Accordingly, because the operation of determining whether an LED is damaged by detecting the drain voltage of a photo transistor is analogous to the above-described operation of detecting the source voltage, its description is omitted.

As mentioned above, the driving control unit 530 compares times at which a gate voltage of each photo transistor is turned on when the light source unit 520 is turned on initially and, based on a comparison result, determines whether an LED is damaged.

Figure 7:
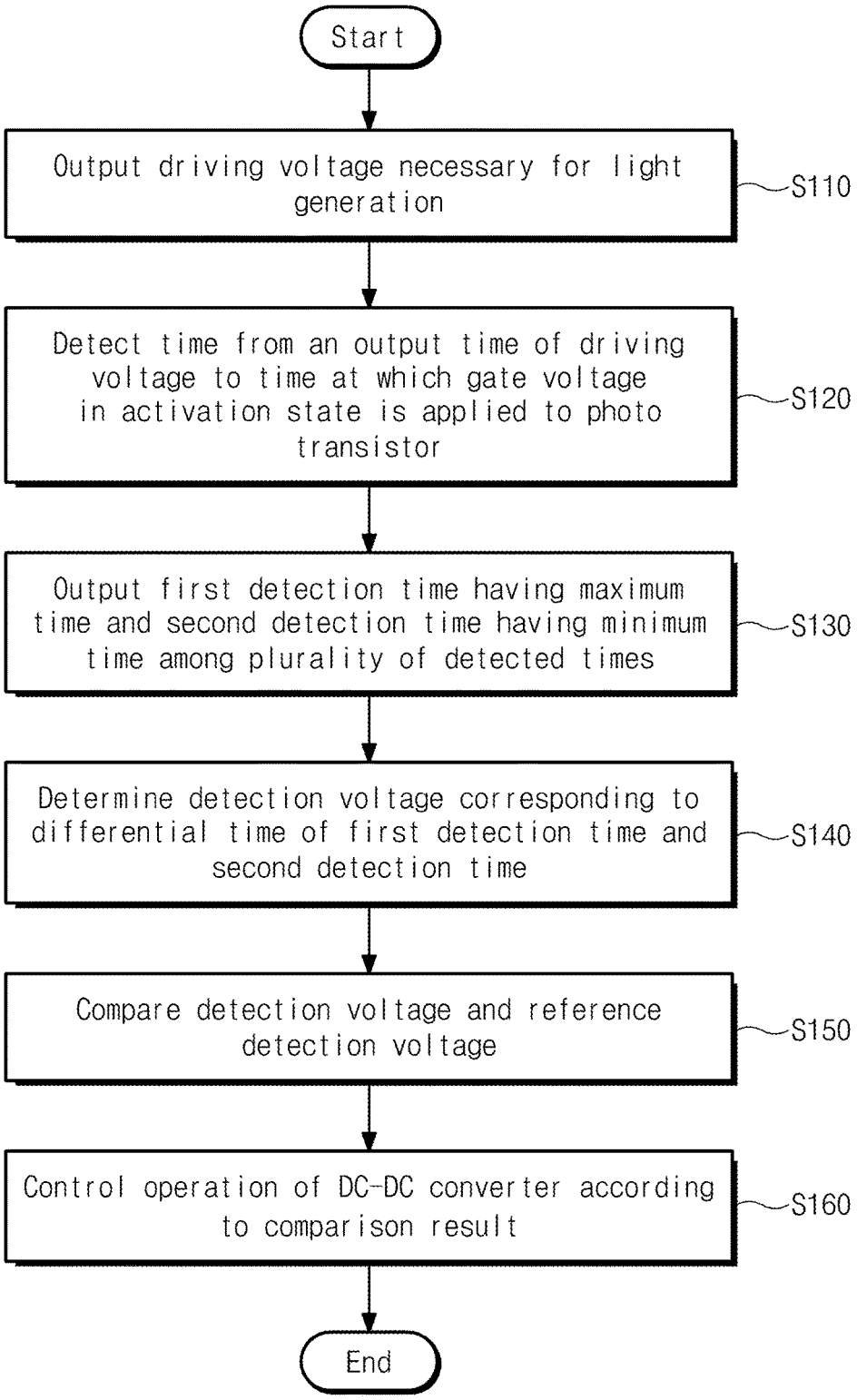
FIG. 7 is a flowchart illustrating a method of operating a backlight unit, according to an embodiment of the present system and method.

FIG. 7 is a flowchart illustrating a method of operating a backlight unit, according to an embodiment of the present system and method. Referring to FIGS. 3 and 7, the DC-DC converter 510 outputs a driving voltage Vo for light generation in operation 5110.

In operation 5120, the driving control unit 530 detects the time differential from when the driving voltage is first output to when a gate voltage is applied to turn on each of the plurality of photo transistors.

In operation 5130, the driving control unit 530 outputs a first detection time having a maximum time and a second detection time having a minimum time among a plurality of detected times.

In operation 5140, the driving control unit 530 determines a detection voltage corresponding to the time differential between the first detection time and the second detection time.

In operation 5150, the driving control unit 530 compares the determined detection voltage and a reference detection voltage.

In operation 5160, the driving control unit 530 outputs a driving pulse signal to control an operation of the DC-DC converter 510 according to the comparison result.

According to an embodiment of the present system and method, the driving reliability of a display device is improved.

The above-disclosed subject matter is to be considered illustrative, and not restrictive, and the appended claims are intended to cover all such modifications, enhancements, and other embodiments, which fall within the true spirit and scope of the present system and method.

What is claimed is:

1. A method of operating a backlight unit, the method comprising:

outputting a driving voltage to a plurality of light emitting strings including at least one light emitting diode;

detecting time differences between an output time and a plurality of applying times, wherein the output time is a time for outputting the driving voltage and the plurality of applying times are times for respectively applying gate voltages to turn on a plurality of photo transistors that respectively control the plurality of light emitting strings;

outputting a first detection time having a maximum time difference and a second detection time having a minimum time difference among the detected time differences;

determining a detection voltage from a plurality of predetermined detection voltages, the detection voltage corresponding to a time difference between the first detection time and the second detection time;

comparing the detection voltage and a reference detection voltage to generate a comparison result; and controlling an output of the driving voltage according to the comparison result.

2. The method of claim 1, wherein the plurality of predetermined detection voltages are predetermined according to a time difference of the maximum time and the minimum time.

3. The method of claim 1, wherein the detection voltage increases with an increase in a time difference of the maximum time and the minimum time.

4. The method of claim 1, wherein one of the plurality of predetermined detection voltages is set as the reference detection voltage.

5. The method of claim 1, wherein when the detection voltage is higher than the reference detection voltage, the driving voltage is prevented from being outputted.

6. A display device comprising:

a backlight unit with a plurality of light emitting strings including at least one light emitting diode; and a display panel displaying an image using light outputted from the backlight unit, wherein the backlight unit comprises:

a light source unit including the plurality of light emitting strings and a plurality of photo transistors controlling the plurality of light emitting strings;

a DC-DC converter outputting the driving voltage to the light source unit; and a driving control unit applying gate voltages to turn on the plurality of photo transistors and detecting driving time differences between an output time for outputting the driving voltage and applying times for applying the gate voltages, wherein the driving control unit selects a first detection time having a maximum time difference and a second detection time having a minimum time difference from the driving time differences, compares a detection voltage corresponding to a time difference between the first and second detection times among a plurality of predetermined detection voltages and a reference detection voltage, and controls an output of the driving voltage according to the comparison result.

7. The display device of claim 6, wherein the DC-DC converter comprises a driving transistor and the output of the driving voltage is adjusted according to the operation of the driving transistor.

8. The display device of claim 7, wherein when the detection voltage is higher than the reference detection voltage, the driving control unit continuously applies a gate voltage to turn off the driving transistor to a gate terminal of the driving transistor.

9. The display device of claim 6, wherein each photo transistor comprises:

a first terminal receiving the gate voltage;

a second terminal connected to each light emitting string; and a third terminal connected to a resistor.

10. The display device of claim 9, wherein the driving control unit comprises:

a driving comparison unit detecting a node voltage of the second terminal or the third terminal of the each photo transistor, comparing the detected node voltage to a reference voltage, and outputting the gate voltage to the each photo transistor according to the comparison result;

a detection unit receiving the driving voltage and the gate voltage applied to each photo transistor and detecting the driving time differences to output the first and second detection times;

a counter unit outputting the detection voltage corresponding to the time difference between the first and second detection times and the reference detection voltage; and a comparator comparing the detection voltage and the reference detection voltage and controlling an output of the driving voltage according to the comparison result.

11. The display device of claim 10, wherein the counter unit comprises a memory, and information on the plurality of predetermined detection voltages is stored in the memory according to a time difference between the maximum time difference and the minimum time difference.

12. The display device of claim 11, wherein the reference detection voltage is set to one of the plurality of predetermined detection voltages.

13. The display device of claim 10, wherein the comparator receives the reference detection voltage through a first comparison terminal and receives the detection voltage through a second comparison terminal, wherein when the detection voltage is higher than the reference detection voltage, the driving voltage is prevented from being outputted.

14. The display device of claim 10, wherein the driving comparison unit comprises a plurality of driving comparators, and each comparator receives the reference voltage through a first driving terminal and receives the node voltage through a second driving terminal.

15. The display device of claim 14, wherein the each driving comparator outputs the gate voltage to turn on a corresponding photo transistor when the node voltage reaches the reference voltage.

* * * * *